US007774889B2

(12) United States Patent
Weaver

(10) Patent No.: US 7,774,889 B2
(45) Date of Patent: Aug. 17, 2010

(54) MOP HEAD CONNECTOR

(75) Inventor: Jace A. Weaver, Gilbertsville, PA (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 440 days.

(21) Appl. No.: 10/988,278

(22) Filed: Nov. 13, 2004

(65) Prior Publication Data

US 2006/0101600 A1 May 18, 2006

(51) Int. Cl.
*A47L 13/42* (2006.01)
*B25G 3/12* (2006.01)

(52) U.S. Cl. ..... 15/145; 15/147.1; 403/377; 403/326

(58) Field of Classification Search ..... 15/229.2, 15/229.1, 147.1, 147.2, 145; 403/300, 306, 403/326–327, 329, 377–378, 379.4, 379.5
See application file for complete search history.

(56) References Cited

U.S. PATENT DOCUMENTS 2,141,994 A * 12/1938 Lamkey ..... 15/147.1
2,675,256 A * 4/1954 Cornell ..... 403/379.2
2,729,841 A * 1/1956 Littleton ..... 15/229.2
4,183,691 A * 1/1980 Van Melle ..... 403/109.3
5,481,949 A * 1/1996 Yen ..... 81/438
5,609,255 A * 3/1997 Nichols ..... 206/576
5,890,254 A * 4/1999 Courtney et al. ..... 15/145

* cited by examiner

*Primary Examiner*—Laura C Guidotti
(74) *Attorney, Agent, or Firm*—Wildman, Harrold, Allen & Dixon LLP

(57) ABSTRACT

A connection system for securing a mop head to a mop handle. The system uses a handle connector component secured to the mop handle and a mop head connector component secured to the mop head. Through holes in the handle connector component are aligned with through holes in the mop head connector component. A resilient clip with protruding tabs is positioned in and around the mop head connector component, such that the tabs of the resilient clips extend through the aligned holes in the connector components. The resiliency of the clips compels the tabs into the holes, thus securing the components.

16 Claims, 4 Drawing Sheets

MOP HEAD CONNECTOR

BACKGROUND OF THE INVENTION

The cleaning section of a mop, normally referred to as the mop head, is routinely secured to the mop's handle by a threaded connection, i.e. threads at the end of the handle are screwed into a threaded opening in the mop head. In this manner, mop heads whose cleaning strands become old and ineffective can be discarded and new heads replaced on the mop handles.

However, this type of connection has several significant disadvantages. The threaded connection system between a handle and a mop head is prone to becoming loose during prolonged use of the mop. This requires constantly stopping the cleaning operation to tighten the handle/mop head connection. Also, repeatedly changing the mop head on the handle tends to cause the threads at the end of the handle to become worn and increasingly ineffective in securing the mop head.

SUMMARY OF THE INVENTION

Accordingly, it the object of the present invention to overcome the limitations and disadvantages of prior mop head connections.

It is an object of the present invention to provide a mop head connection system which ensures for a quick and easy attachment between the mop head and handle.

It is another object of the present invention to provide a mop connection system for ensuring that there is always a secure connection between the mop head and the handle, especially during prolonged use of the mop.

It is another object of the present invention to provide a mop head connection system which is simple and economical to produce and which has a limited number of connection components.

It is a further object of the present invention to provide a mop head connection system with an attachment element which provides an easy and effective connection between the mop head and mop handle.

It is still another object of the present invention to provide a mop head connection system which uses a resilient clip to quickly and securely connect the mop head to the mop handle.

These and other objects are accomplished by the present invention, a mop head connection system which has a handle connector component secured to the mop handle and a mop head connector component secured to the mop head. Through holes in the handle connector component are aligned with through holes in the mop head connector component. A resilient clip with protruding tabs is positioned in and around the mop head connector component, such that the tabs of the resilient clips extend through the aligned holes in the connector components. The resiliency of the clips compels the tabs into the holes, thus securing the components.

The novel features which are considered as characteristic of the invention are set forth in particular in the appended claims. The invention itself, however, both as to its design, construction, and use, together with the additional features and advantages thereof, are best understood upon review of the following detailed description with reference to the accompanying drawings.

DETAILED DESCRIPTION OF THE INVENTION

Figure 1:
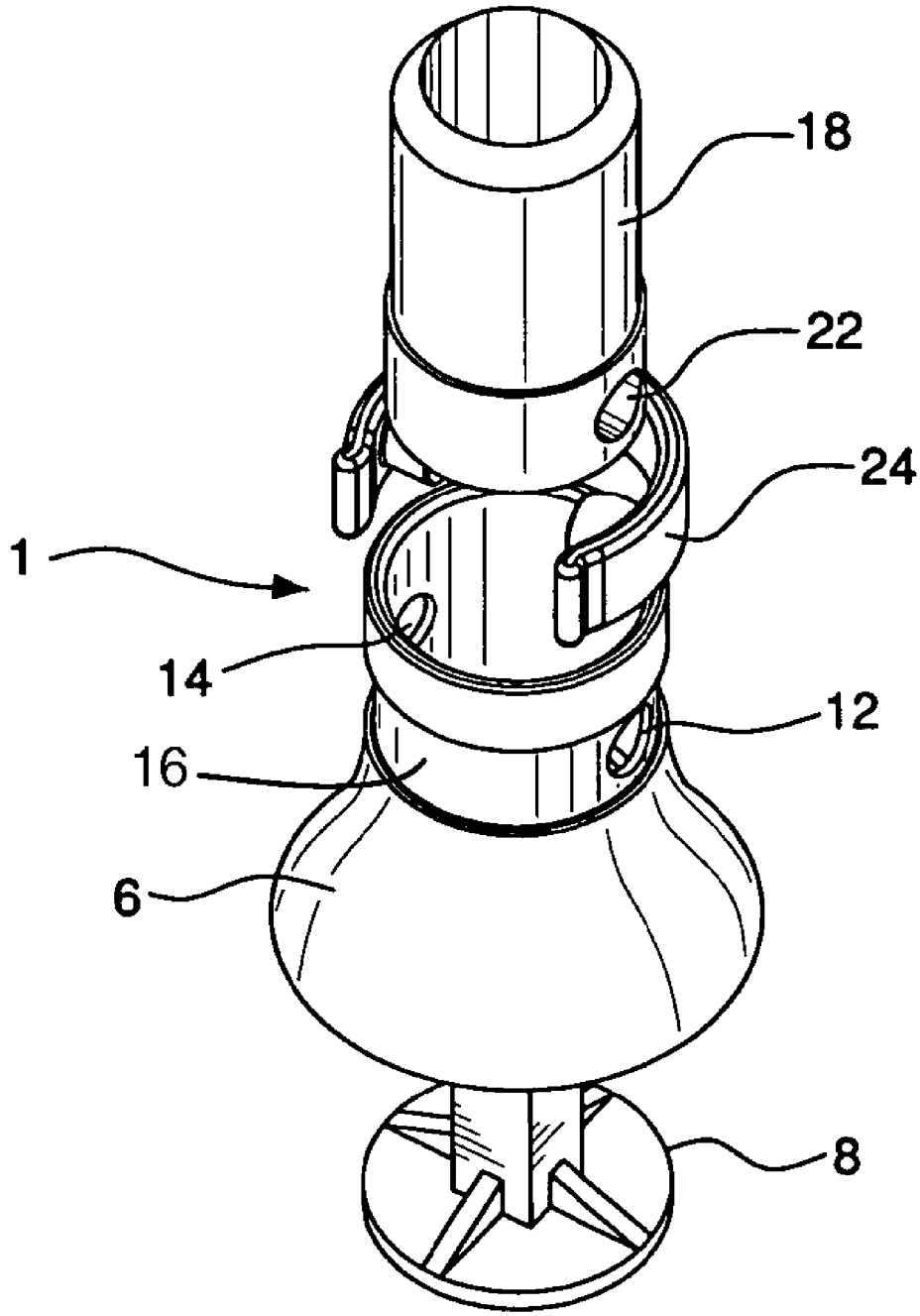
FIG. 1 is an isometric exploded view showing the alignment of the components of the mop head connection system of the present invention.

With reference to FIG. 1 the mop head connection system 1 of the present invention is used on a mop comprising mop head 2 with cloth strands 4 which are secured in conventional fashion to mop head connector component 6 via mop strand connector 8. Mop head connector 6 has opening 10 at its upper end section 15, a recess 16 defined in the upper end section 15, and through openings 12 and 14 disposed in the recess 16 and parallelly aligned on either side of the upper end section of the mop head connector. Mop handle 21 is permanently connected by pressure fitting, tacks, or other known means, to one end of handle connector component 18. Handle connector 18 is substantially cylindrical in configuration and, at its lower end 19, comprises through openings 20 and 22 parallelly aligned on opposite sides of the connector. As seen in FIG. 1, handle connector 18 is configured to be inserted into mop head connector 6, such that through holes 20 and 22 of handle connector 18 and through holes 12 and 14 of mop head connector 6 are aligned with each other, forming an open pathway completely through the two overlaying connector components.

Figure 2:
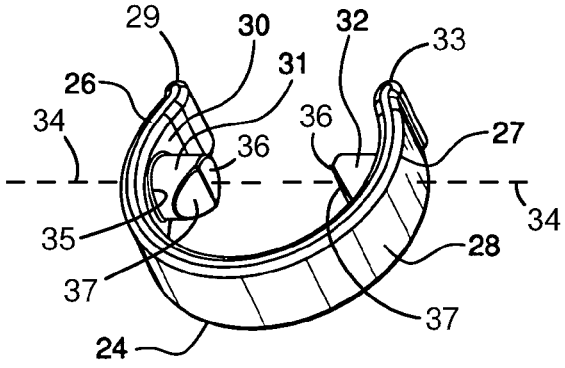
FIG. 2 is an isometric view of the clip component of the mop head connection system of the present invention.
Figure 3:
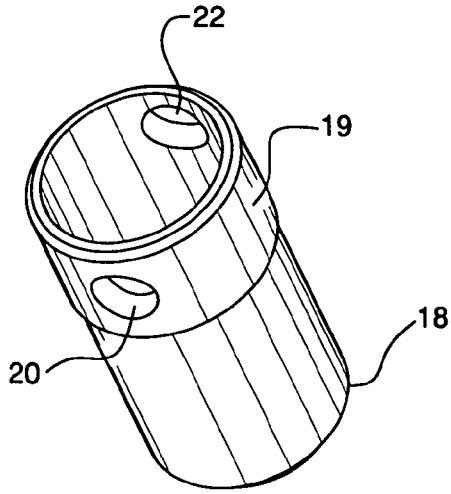
FIG. 3 is an isometric view of the mop head connector component of the mop head connection system of the present invention.
Figure 4:
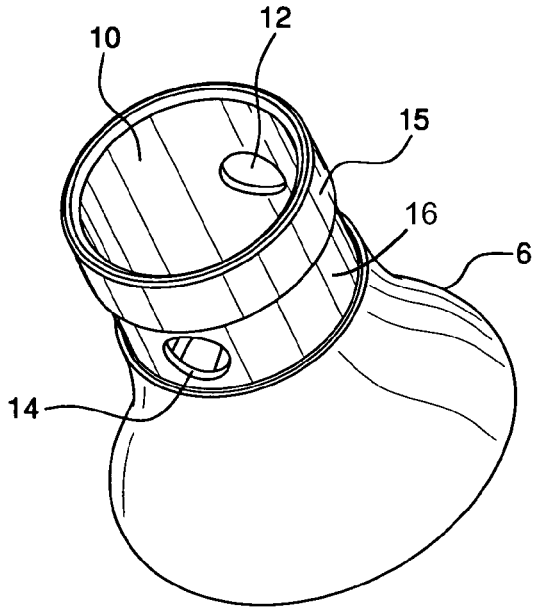
FIG. 4 is an isometric view of the handle connector component of the mop head connection system of the present invention.
Figure 5:
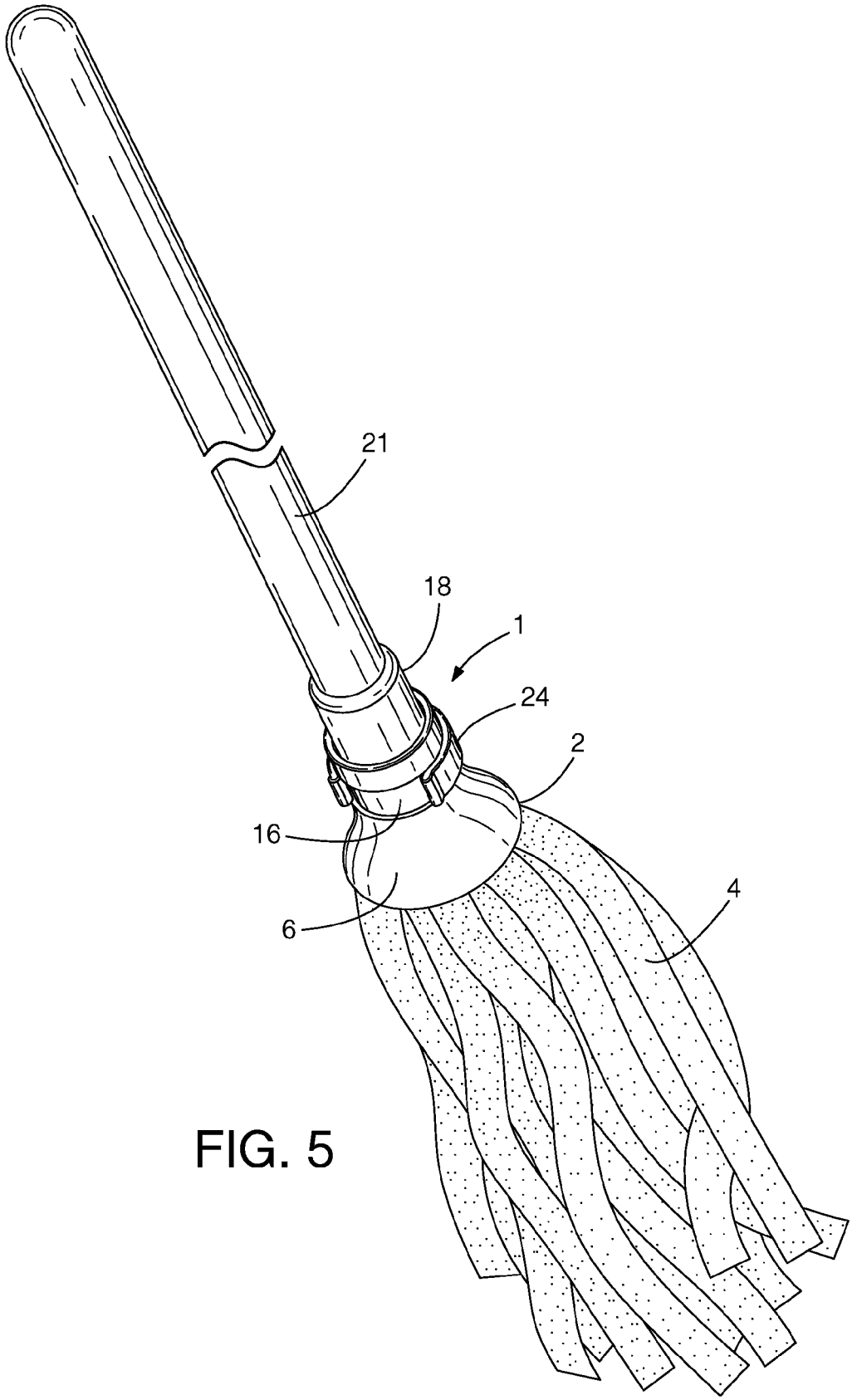
FIG. 5 is an isometric view of a mop head secured to a mop handle, using the mop head connection system of the present invention.
Figure 6:
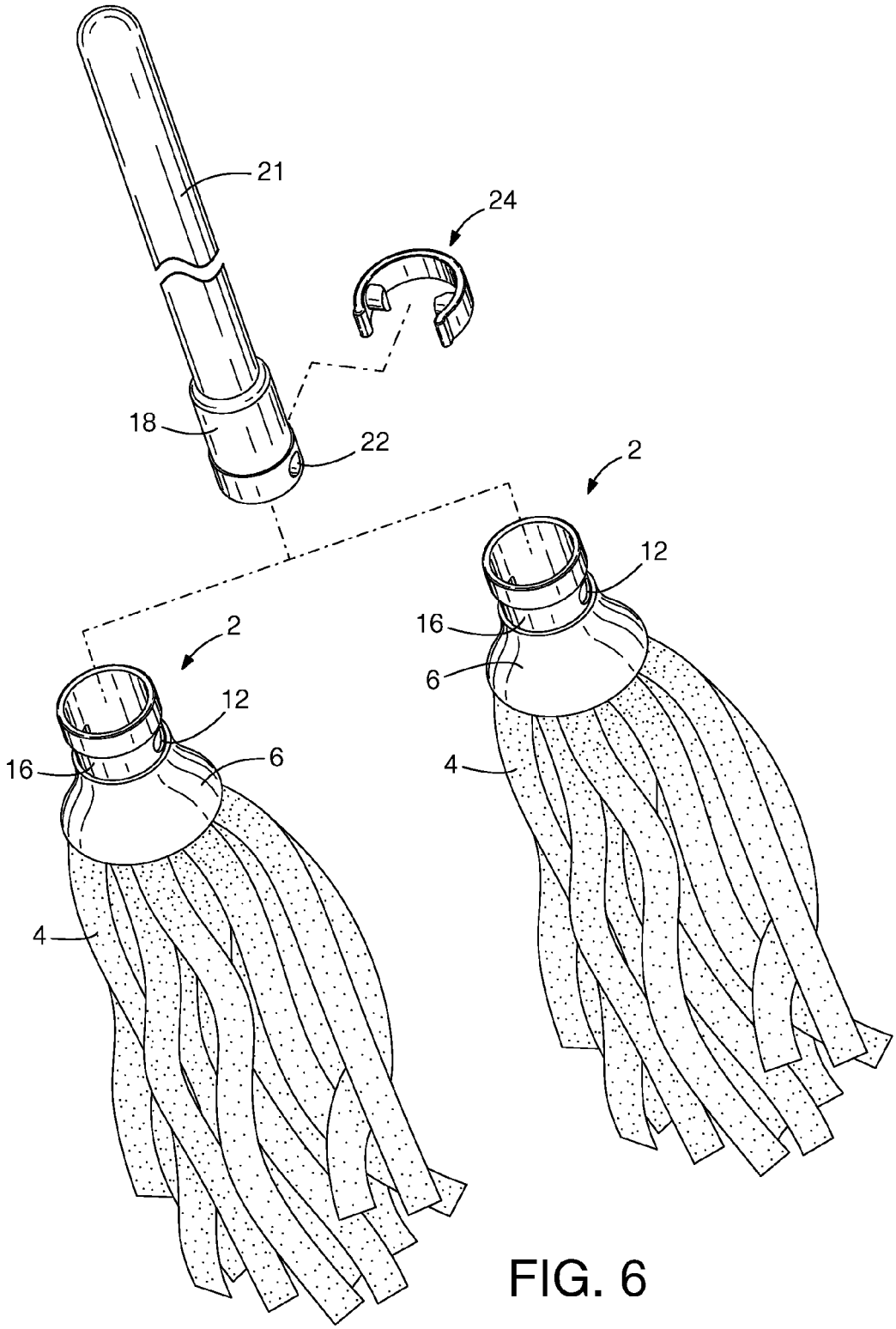
FIG. 6 is an isometric view of a combination of a mop handle and a pair of mop heads interchangeably connectable to the mop handle using the connection system of FIGS. 1-5.

With reference to FIG. 2, clip 24 is curvilinear or semicircular in configuration and comprises arms 26 and 27 with each arm 26 and 27 having a respective end 29 and 33. The clip 24 also comprises an outside convex surface 28, an inside concave surface 30, and tabs 31 and 32 extending from inside surface 30 and spaced inward from respective ends 29 and 33, as shown in FIG. 2. Each of the tabs 31 and 32 includes a longitudinal axis 34, a first end 35 adjacent inside surface 30, a second end 36 spaced apart from first end 35, and a ramped surface 37 adjacent the second end 36. The tabs 31 and 32 are parallelly aligned with one another (see parallely aligned longitudinal axes 34 in FIG. 2). Clip 24 is resilient, thus permitting arms 26 and 27 to be expanded outward and, upon release, to return to their original configuration.

After handle connector 18 is inserted into mop head connector 6, such that through openings 12, 14, 20, and 22 are aligned to form an opened pathway through both connector components, clip 24 is positioned over and around upper end section 15 of mop head connector 6. Arms 26 and 27 of clip 24 are spread apart and clip 24 is placed in the recess 16 of mop head connector 6, with tabs 31 and 32 being inserted into through holes 12 and 14. The resiliency of clip 24 compels arms 26 and 27 of the clip to tighten into recess 16 and around the upper end section 15 of mop head connector 6, forcing tabs 31 and 32 to snap into through openings 12, 14, 20, and 22. This joins mop head connector 6 and handle connector 18, resulting in a secure connection between mop head 2 and handle 20.

The secure connection provided by mop head connection system 1, by use of clip 24 resiliently maintaining mop head connection 6 and handle connector 18, ensures that the handle to mop head connection of the mop is maintained during use of the mop.

When it is desired to change mop head 2, after prolonged use of the mop head, arms 26 and 27 of resilient clip 24 can be spread apart, allowing the clip to be removed from through openings 12, 14, 20, and 22. This allows handle 21 with handle connector 18 to be withdrawn from mop head connector 6 and mop head 2. Handle connector 18 can then be inserted into opening 10 of new mop head connector 6, which is a component of a fresh, clean mop head 2. Through openings 12 and 14 of mop head connector 6 and through openings 20 and 22 of handle connector 18 are once again aligned, and resilient clip 24 reattached to the system. The mop is once again ready for use with a new, clean-mop head.

Certain novel features and components of this invention are disclosed in detail in order to make the invention clear in at least one form thereafter. However, it is to be clearly understood that the invention as disclosed is not necessarily limited to the exact form and details as disclosed since it is apparent that various modifications and changes may be made without departing from the spirit of the invention.

The invention claimed is:

1. A mop, comprising:

a handle including a handle connector positioned at an end of the handle, the handle connector including a pair of handle openings;

a mop head removably connected to the handle and including at least one cleaning implement and a mop head connector, the mop head connector including an outer surface, a recess defined in the outer surface, and a pair of mop head openings completely disposed in the recess; and a resilient clip substantially semi-circular in shape and including an inner concave surface, an outer convex surface, and a pair of tabs substantially cylindrical in shape extending from the inner concave surface, each tab has a first end adjacent the inner concave surface, a second end spaced apart from the first end and the inner concave surface, a ramped surface adjacent the second end, and a central longitudinal axis, wherein the central longitudinal axes of the pair of tabs are linearly aligned with one another and extend transverse to the inner concave surface of the clip, and wherein the clip removably connects the mop head to the handle by aligning the pair of handle openings with the pair of mop head openings, positioning the clip in the recess of the mop head connector, and positioning the pair of tabs in the aligned pairs of handle and mop head openings, and wherein the mop head is removed from the handle by removing the tabs of the clip from the aligned pairs of handle and mop head openings.

2. The mop of claim 1, wherein the handle openings are linearly aligned on opposite sides of the handle connector and the mop head openings are linearly aligned on opposite sides of the mop head connector.

3. The mop of claim 1, wherein the handle openings are on opposite sides of the handle connector and are substantially circular in shape, each handle opening includes a central axis extending through a center of the circular handle opening, and wherein the central axes of the handle openings are linearly aligned.

4. The mop of claim 3, wherein the mop head openings are on opposite sides of the mop head connector and are substantially circular in shape, each mop head opening includes a central axis extending through a center of the circular mop head opening, and wherein the central axes of the mop head openings are linearly aligned.

5. The mop of claim 1, wherein the resilient clip is resiliently moveable between a first position, in which the tabs are positioned in aligned pairs of handle and mop head openings to connect the mop head to the handle, and a second position, in which the clip is deflected to remove the tabs from the aligned pairs of handle and mop head openings and facilitate removal of the mop head from the handle.

6. The mop of claim 5, wherein the clip returns to the first position from the second position due to resiliency of the clip.

7. The mop of claim 1, wherein the clip has a pair of ends and wherein the tabs are spaced inward from the ends.

8. The mop of claim 1, wherein the clip has a pair of ends extending out of alignment with the semi-circular clip.

9. The mop of claim 8, wherein the ends of the clip extend outwardly out of alignment with the semi-circular clip.

10. A combination, comprising:

a handle including a handle connector positioned at an end of the handle, the handle connector including a pair of handle openings;

a first mop head removably connected to the handle and including at least one cleaning implement and a first mop head connector, the first mop head connector including a first outer surface, a first recess defined in the first outer surface, and a first pair of mop head openings completely disposed in the first recess;

a second mop head removably connected to the handle and including at least one cleaning implement and a second mop head connector, the second mop head connector including a second outer surface, a second recess defined in the second outer surface, and a second pair of mop head openings disposed in the second recess; and a clip substantially semi-circular in shape and including an inner concave surface, an outer convex surface, and a pair of tabs substantially cylindrical in shape extending from the inner concave surface, each tab has a first end adjacent the inner concave surface, a second end spaced apart from the first end and the inner concave surface, a ramped surface adjacent the second end, and a central longitudinal axis, wherein the central longitudinal axes of the pair of tabs are linearly aligned with one another and extend transverse to the inner concave surface of the clip;

wherein the clip removably connects one of the first and second mop heads to the handle at a time by aligning the pair of handle openings with the one of the first and second pairs of mop head openings, positioning the clip in the one of the first and second recesses, and positioning the pair of tabs in the aligned pair of handle openings and the one of the first and second pairs of mop head openings; and wherein the one of the first and second mop heads is removed from the handle by removing the tabs of the clip from the aligned pair of handle openings and the one of the first and second pairs of mop head openings; and wherein the other of the first and second mop heads is connected to the handle using the clip.

11. The combination of claim 10, wherein the other of the first and second mop heads is connected to the handle by aligning the pair of handle openings with the other of the first and second pairs of mop head openings, positioning the clip in the other of the first and second recesses, and positioning the pair of tabs in the aligned pair of handle openings and the other of the first and second pairs of mop head openings.

12. The combination of claim 10, wherein the handle openings are linearly aligned on opposite sides of the handle connector, the first mop head openings are linearly aligned on opposite sides of the first mop head connector, and the second mop head openings are linearly aligned on opposite sides of the second mop head connector.

13. The combination of claim 10, wherein the handle openings are on opposite sides of the handle connector and are substantially circular in shape, each handle opening includes a central axis extending through a center of the circular handle opening, and wherein the central axes of the handle openings are linearly aligned.

14. The combination of claim 13, wherein the first mop head openings are on opposite sides of the first mop head connector and are substantially circular in shape, each of the first mop head openings includes a central axis extending through a center of the circular first mop head opening, and wherein the central axes of the first mop head openings are linearly aligned, and wherein the second mop head openings are on opposite sides of the second mop head connector and are substantially circular in shape, each of the second mop head openings includes a central axis extending through a center of the circular second mop head opening, and wherein the central axes of the second mop head openings are linearly aligned.

15. The combination of claim 10, wherein the clip is a resilient clip and is resiliently moveable between a first position, in which the tabs are positioned in the aligned pair of handle openings and the one of the first and second pairs of mop head openings to connect the one of the first and second mop heads to the handle, and a second position, in which the clip is deflected to remove the tabs from the aligned pair of handle openings and the one of the first and second pairs of mop head openings to facilitate removal of the one of the first and second mop heads from the handle.

16. The combination of claim 15, wherein the clip returns to the first position from the second position due to resiliency of the clip.

* * * * *